US007261089B2

(12) United States Patent
Hoenig et al.

(10) Patent No.: US 7,261,089 B2
(45) Date of Patent: Aug. 28, 2007

(54) FUEL INJECTOR NOZZLE SEAL

(75) Inventors: Guenter Hoenig, Ditzingen (DE); Gernot Wuerfel, Vaihingen/Enz (DE); Detlef Nowak, Heilbronn (DE); Andreas Mlejnek, Stuttgart (DE); Klaus Roessler, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/566,534

(22) PCT Filed: Aug. 18, 2004

(86) PCT No.: PCT/EP2004/051820

§ 371 (c)(1),
(2), (4) Date: Aug. 18, 2006

(87) PCT Pub. No.: WO2005/019640

PCT Pub. Date: Mar. 3, 2005

(65) Prior Publication Data

US 2007/0000480 A1 Jan. 4, 2007

(30) Foreign Application Priority Data

Aug. 18, 2003 (DE) ..... 103 37 892

(51) Int. Cl.
*F02M 61/14* (2006.01)
*F02M 37/04* (2006.01)

(52) U.S. Cl. ..... 123/470; 277/644; 277/313; 277/591; 239/132.5; 123/467

(58) Field of Classification Search ..... 123/470, 123/467; 277/644, 313, 591; 239/132.5
See application file for complete search history.

(56) References Cited

U.S. PATENT DOCUMENTS

| | | | | |
|---|---|---|---|---|
| 4,589,596 | A * | 5/1986 | Stumpp et al. | 239/397.5 |
| 5,129,658 | A * | 7/1992 | Berton et al. | 277/591 |
| 5,381,600 | A * | 1/1995 | Patel | 29/890.044 |
| 6,009,856 | A | 1/2000 | Smith, III et al. | |
| 6,295,969 | B1 * | 10/2001 | Kato et al. | 123/470 |
| 6,481,421 | B1 * | 11/2002 | Reiter | 123/470 |
| 6,578,554 | B2 * | 6/2003 | Schroeer | 123/470 |
| 7,047,949 | B2 * | 5/2006 | Reiter et al. | 123/516 |
| 2002/0157648 | A1 | 10/2002 | Reiter | |

FOREIGN PATENT DOCUMENTS

| | | |
|---|---|---|
| DE | 199 55 896 | 5/1986 |
| DE | 101 09 407 | 9/2002 |
| EP | 0 828 075 | 3/1998 |
| GB | 730 432 | 5/1955 |

* cited by examiner

*Primary Examiner*—Stephen K. Cronin
*Assistant Examiner*—J. Page Hufty
(74) *Attorney, Agent, or Firm*—Kenyon & Kenyon LLP

(57) ABSTRACT

A fuel injector for the direct injection of fuel into the combustion chamber of a mixture-compressing internal combustion engine having external ignition includes a valve housing formed by a nozzle body, and a seal which seals the fuel injector from a cylinder head of the internal combustion engine. The seal has a sleeve-type design with a structured cross section and extends across the axial length of the nozzle body.

12 Claims, 4 Drawing Sheets

FUEL INJECTOR NOZZLE SEAL

FIELD OF THE INVENTION

The present invention relates to a fuel injector for direct injection of fuel, which fuel injector is provided with a seal.

BACKGROUND INFORMATION

Published European patent document EP 0 828 075 describes a fuel injector for the direct injection of fuel into the combustion chamber of an internal combustion engine, which has a device for adjusting the temperature in the region of the valve tip so as to reduce deposits in this area. The device is embodied in the form of a coating made of a thermally conductive material on the valve tip.

Disadvantages of the fuel injector described in the European patent document EP 0 828 075 are the high demands regarding the accuracy of fit of the components and the complicated installation, which is involved and thus cost-intensive.

Furthermore, a fuel injector for the direct injection of fuel into the combustion chamber of a mixture-compressing internal combustion engine having external ignition is described in published German patent document DE 101 09 407. It includes a valve housing formed by a nozzle body, and a sealing ring which seals the fuel injector from a cylinder head of the internal combustion engine. The sealing ring has a convexly arched profile, the two ends of the sealing ring axially overlapping in the form of a step.

Particularly disadvantageous in the fuel injector described in published German patent document DE 101 09 407 is the air gap between the fuel injector and the cylinder head, which allows only limited heat transfer. This is disadvantageous in reducing deposits on the valve tip since the temperature in the region of the spray-discharge orifices must be as low as possible so as to avoid deposits.

SUMMARY

In contrast, the fuel injector according to the present invention has the advantage that a seal is situated between the cylinder head and the nozzle body, the seal extending over the entire axial length and having a suitable structure, thereby providing not only a reliable sealing effect but effective heat dissipation away from the nozzle body as well.

It is particularly advantageous that any desired cross sections are possible, e.g., corrugated tubes, convoluted bellows, and smooth tubular bodies having protuberances formed in a variety of shapes.

In an advantageous manner the seal may also be made up of a plurality of layers, which gives it higher stability and makes it less likely to be damaged during the installation.

In addition, it is advantageous that a cover plate, which functions as heat shield, may be situated on a discharge-side end of the seal. The cover plate may have an opening for the spray-discharged fuel jets or it may have a plurality of spray-discharge openings.

The seal may be produced from a metallic material having an amorphous structure, so that a smooth surface is able to be achieved.

DETAILED DESCRIPTION

Figure 1:
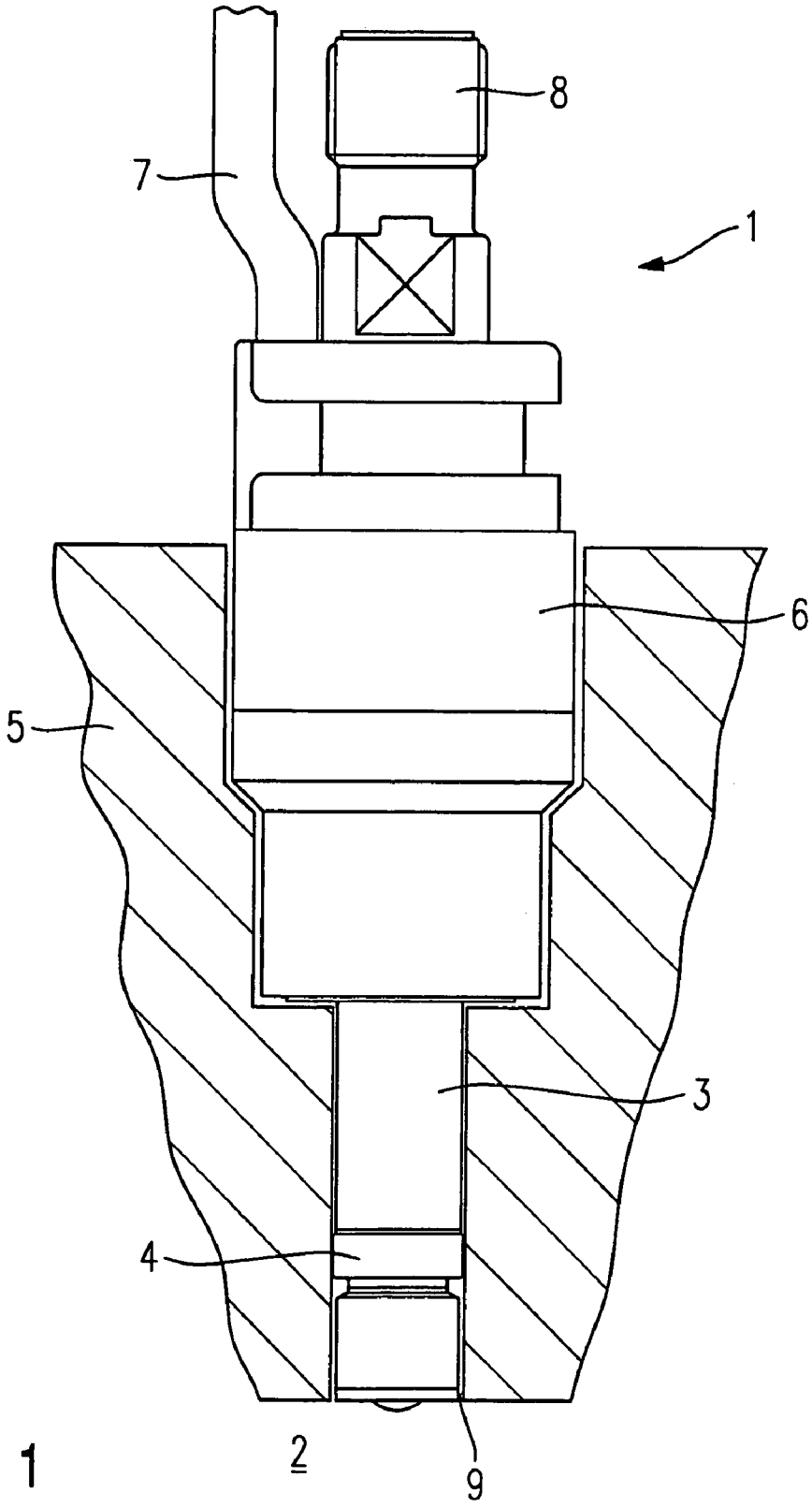
Fig. 1 Prior Art
FIG. 1 shows a schematic cross-sectional view through a conventional fuel injector.

Before example embodiments of a fuel injector 1 according to the present invention are described in greater detail in connection with FIGS. 2 through 7, for a better understanding of the present invention, a conventional fuel injector 1 will be briefly explained in terms of its essential components on the basis of FIG. 1.

Fuel injector 1 is configured for fuel-injection systems of mixture-compressing internal combustion engines with externally supplied ignition. Fuel injector 1 is suited, e.g., for the direct injection of fuel into a combustion chamber 2 of an internal combustion engine.

Fuel injector 1 includes a nozzle body 3, which is sealed from a cylinder head 5 of the internal combustion engine by a sealing ring 4. Sealing ring 4 is made of, for instance, an elastomeric material such as a Teflon-coated material and provides the sealing effect in cylinder head 5 as a result of a slightly larger diameter compared to nozzle body 3.

Furthermore, fuel injector 1 includes a housing 6, an electric plug-in contact 7 for actuating fuel injector 1, and a fuel feed 8, via which the fuel is conveyed. Fuel may be supplied via a fuel-distributor line, for example, which is not shown further.

Disadvantages of the sealing rings 4 in the conventional configuration is, in particular, the poor heat transfer between nozzle body 3 and cylinder head 5 because of an air gap 9 on the discharge side between fuel injector 1 and cylinder head 5. In order to counter the threat of coking of the spray-discharge orifices of directly-injecting fuel injectors 1 as a result of the high temperatures in combustion chamber 2, the lowest possible temperature is to be desired in the region of the valve tip. This prevents a complete evaporation of the fuel remaining in the region of the valve tip after the injection process. If the fuel remains liquid, the combustion residue and impurities are unable to deposit in the region of the valve tip and are carried away during the next injection cycle.

The poor heat transfer between fuel injector 1 and cylinder head 5 in the conventional configuration is counteracted by a seal 10 configured according to the present invention, as illustrated by example embodiments shown in FIGS. 2 through 7.

Seals 10 described below all have in common the fact that they are designed as corrugated tubes and thus not only provide excellent sealing action but also offer a sufficiently large contact surface for an effective heat transfer between fuel injector 1 and cylinder head 5. Seals 10 are designed in such a way that they are short and broad in the non-installed state, but are pressed together slightly by the installation and become longer as a result. This makes it possible to achieve an excellent fit.

Seals 10 are made of a material that exhibits great thermal conductivity, e.g., a metal foil having an amorphous structure, so that it is possible to achieve a very smooth surface with the advantage of a simple and damage-free installation.

Cavities 16 formed between fuel injector 1 and seal 10 by the different cross-sectional forms may be used for passing through a coolant.

In the following, example embodiments for fuel injectors 1 provided with corresponding seals 10 will be described. With the exception of the inventive measures provided according to the present invention, fuel injectors 1 according to the present invention may be designed similar to the conventional fuel injector illustrated in FIG. 1.

Figure 2:
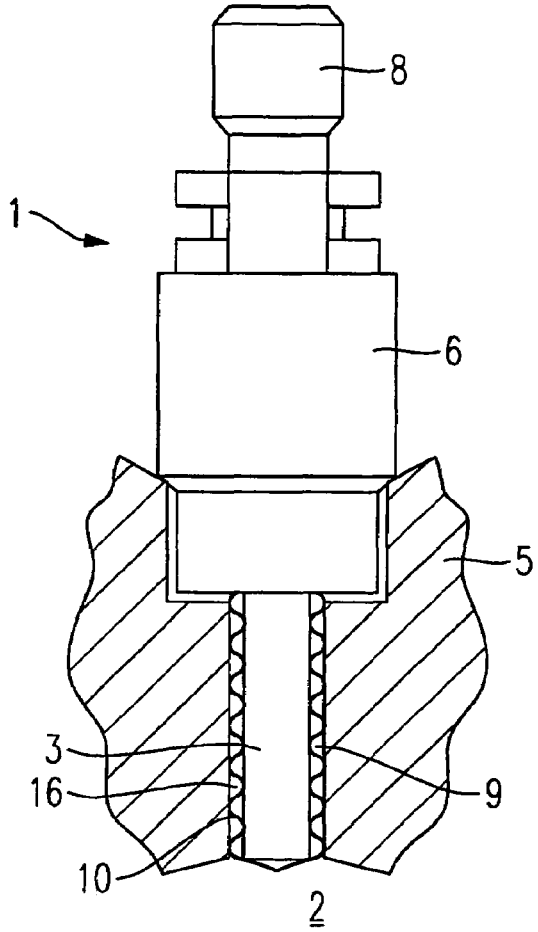
FIG. 2 shows a schematic cross-sectional view of a first example embodiment of a fuel injector according to the present invention.

FIG. 2 shows a first example embodiment of a fuel injector 1 configured according to the present invention. Here, in the simplest manner, seal 10 has the form of a corrugated tube. Seal 10 is open at both sides and is thus able to be mounted in an especially uncomplicated manner. Seal 10 may be premounted on nozzle body 3 of fuel injector 1 and then inserted into cylinder head 5 together with it.

Figure 3:
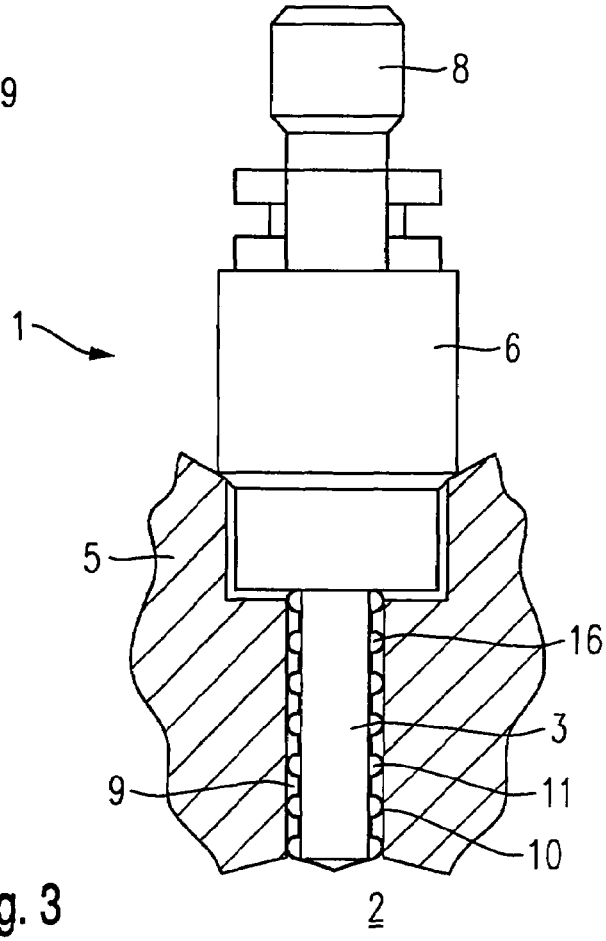
FIG. 3 shows a schematic cross-sectional view of a second example embodiment of a fuel injector according to the present invention.

FIG. 3 shows a second example embodiment of a fuel injector 1 configured according to the present invention. In this example embodiment, seal 10 has the form of a tubular seal 10 having protrusions 11. Protrusions 11 are approximately semicircular in section. The advantage of this embodiment is a slightly larger contact surface on nozzle body 3 resulting in improved thermal conductivity.

Figure 4:
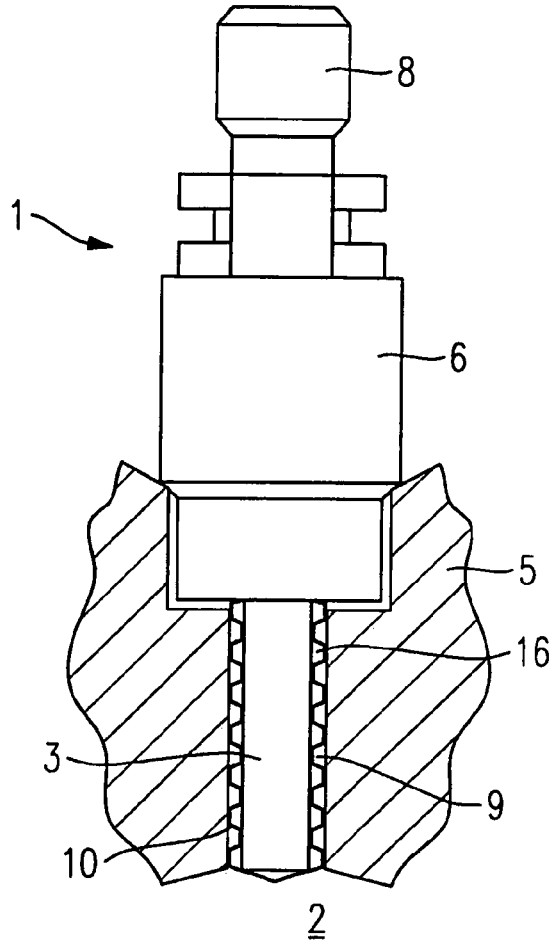
FIG. 4 shows a schematic cross-sectional view of a third example embodiment of a fuel injector according to the present invention.

FIG. 4 shows a third example embodiment of a fuel injector 1 configured according to the present invention. In this case seal 10 has a pleated design and has been formed into expansion bellows 10. The thermal conductivity and sealing ability correspond approximately to that of the first example embodiment described in FIG. 2.

Figure 5:
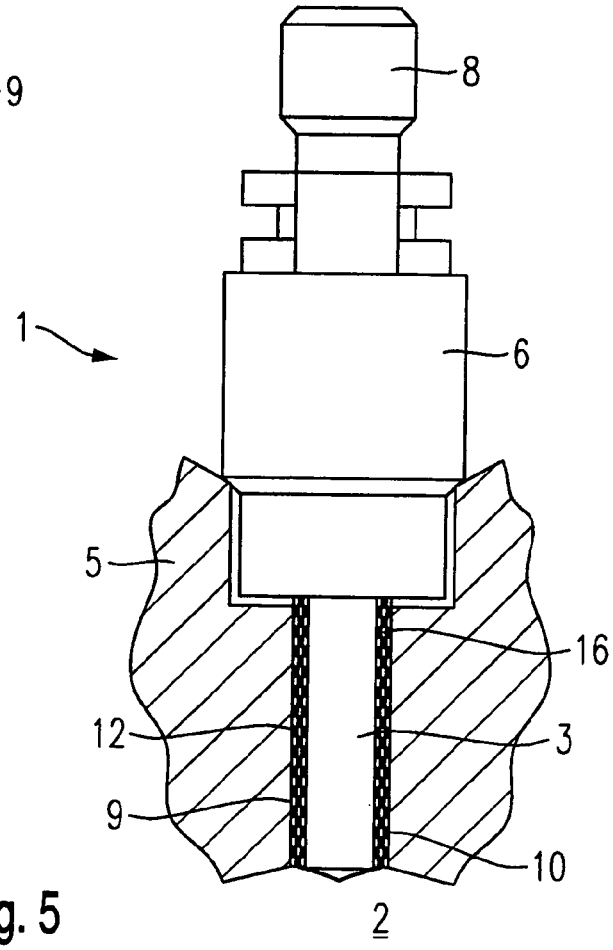
FIG. 5 shows a schematic cross-sectional view of a fourth example embodiment of a fuel injector according to the present invention.

FIG. 5 shows a fourth example embodiment of a fuel injector 1 configured according to the present invention. Here, seal 10 is made up of a plurality of layers 12 in a sandwich-like manner. This increases the durability of seal 10, in particular, which is unable to deform as easily during installation and thus is less likely to be damaged. The individual layers 12 may in turn be designed in the form of a corrugated-tube and be bonded to each other, or they may be joined to each other only at their ends.

Figure 6:
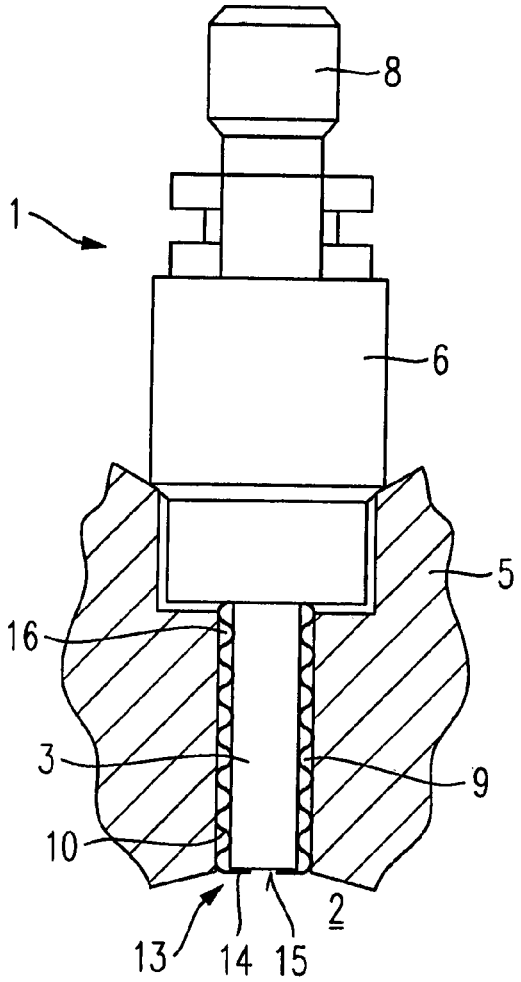
FIG. 6 shows a schematic cross-sectional view of a fifth example embodiment of a fuel injector according to the present invention.

FIG. 6 shows a fifth example embodiment of a fuel injector 1 configured according to the present invention. Here, seal 10 may have the same cross-sectional design as seals 10 according to the example embodiments illustrated in FIGS. 2 through 5, the corrugated tube design having been chosen in FIG. 6. In addition, on a discharge-side end 13, it is provided with a cover plate 14 which has an opening 15 for the fuel jets injected into combustion chamber 2 from at least one spray-discharge orifice of fuel injector 1. Cover plate 14 additionally has the function of a heat shield and protects the spray-discharge orifices from the high temperature prevailing in the combustion chamber, the high temperatures increasing the coking tendency of the spray-discharge orifices.

Figure 7:
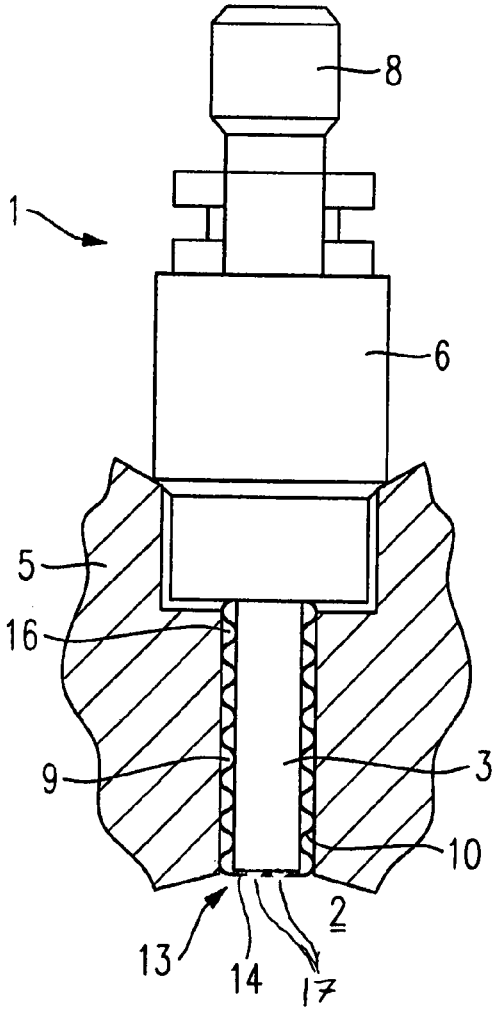
FIG. 7 shows a schematic cross-sectional view of a sixth example embodiment of a fuel injector according to the present invention.

FIG. 7 shows a sixth example embodiment of a fuel injector 1 configured according to the present invention. Here, as in the example embodiment shown in FIG. 6, seal 10 may have the same sectional design as seals 10 illustrated in FIGS. 2 through 5, the corrugated tube design having been chosen in FIG. 7 as well. Seal 10 has a cover plate 14 on a discharge-side end 13, into which the spray-discharge orifices 17 may be worked directly. Cover plate 14 also assumes the function of a heat shield and protects the discharge-side end of fuel injector 1 from the temperature prevailing in the combustion chamber.

The present invention is not restricted to the example embodiments shown, but is also applicable to other cross-sectional forms of seals 10, as well as to a wide variety of construction types of fuel injectors 1, such as fuel injectors 1 having an interface to an intake manifold or a common-rail system.

In addition, the individual features of the various example embodiments may be combined with each other as desired.

What is claimed is:

1. A fuel injector for direct injection of fuel into a combustion chamber of a mixture-compressing internal combustion engine having external ignition, comprising:

a nozzle body;

a valve housing surrounding the nozzle body; and a seal which seals at least the nozzle body from a cylinder head of the internal combustion engine, wherein the seal has a sleeve-type design with a structured cross section, wherein the seal extends across the axial length of the nozzle body, and wherein the seal directly contacts both the nozzle body and a receiving bore of the cylinder head in order to achieve a reliable sealing effect and effective heat dissipation from the nozzle body.

2. The fuel injector as recited in claim 1, wherein the seal is in the form of a corrugated tube.

3. The fuel injector as recited in claim 1, wherein the seal is in the form of a tube having protrusions.

4. The fuel injector as recited in claim 3, wherein the protrusions have a semicircular cross section.

5. The fuel injector as recited in claim 1, wherein the seal is pleated in the shape of expansion bellows.

6. The fuel injector as recited in claim 1, wherein the seal includes a plurality of layers.

7. The fuel injector as recited in claim 6, wherein the seal includes a cover plate on a discharge-side end of the nozzle body.

8. The fuel injector as recited in claim 7, wherein the cover plate has at least one opening.

9. The fuel injector as recited in claim 8, wherein the opening of the cover plate facilitates passage of fuel jets injected into the combustion chamber.

10. The fuel injector as recited in claim 8, wherein the cover plate includes a plurality of spray-discharge orifices.

11. The fuel injector as recited in claim 8, wherein the seal is produced from a metal foil having a smooth surface, the metal foil produced from a metallic material having an amorphous structure.

12. The fuel injector as recited in claim 2, wherein a plurality of cavities is formed one of: a) between the seal and the nozzle body; and b) between the seal and the cylinder head, and wherein the cavities are configured to channel a flow of coolant.

* * * * *